United States Patent [19]

Van Scoyk

[11] Patent Number: 4,879,865

[45] Date of Patent: Nov. 14, 1989

[54] SADDLE BLANKET WITH COMPARTMENTS

[76] Inventor: Pershing R. Van Scoyk, 7193 W. 32nd Ave., Wheat Ridge, Colo. 80033

[21] Appl. No.: 226,129

[22] Filed: Jul. 29, 1988

[51] Int. Cl.[4] ..... B68C 1/12; B68C 1/20

[52] U.S. Cl. ..... 54/66; 54/44

[58] Field of Search ..... 54/44, 46, 65, 66, 41; 224/191, 197, 223

[56] References Cited

U.S. PATENT DOCUMENTS

| | | | |
|---|---|---|---|
| 13,864 | 12/1855 | Campbell | 54/44 |
| 28,867 | 6/1860 | Jenifer | 54/46 |
| 136,155 | 2/1873 | Groff et al. | 54/66 |
| 3,957,282 | 5/1976 | Finnigan | 224/191 X |

*Primary Examiner*—Robert P. Swiatek

*Attorney, Agent, or Firm*—Dorr, Carson, Sloan & Peterson

[57] ABSTRACT

The present invention is an improved saddle blanket having compartments attached to the periphery of the rear end of the blanket. The compartments include a center compartment contoured to conform the cantle of the saddle. The skirt of the saddle is slipped between the compartments and the blanket so the center compartment is pushed against the cantle of the saddle. The saddle and compartments are thus stabilized from bouncing and slipping relative to another.

13 Claims, 4 Drawing Sheets

Fig. 2
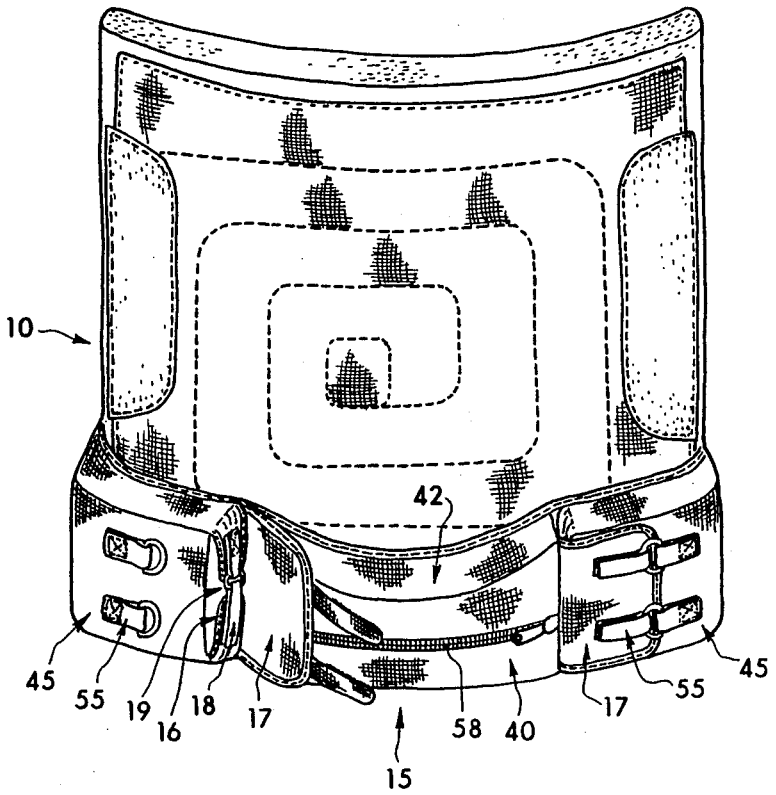
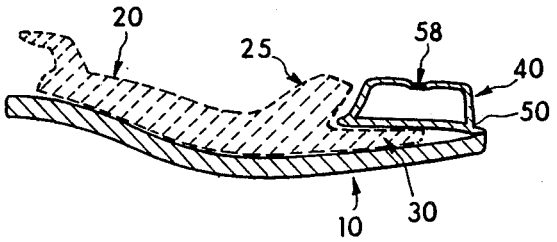
Fig. 7

Fig. 3
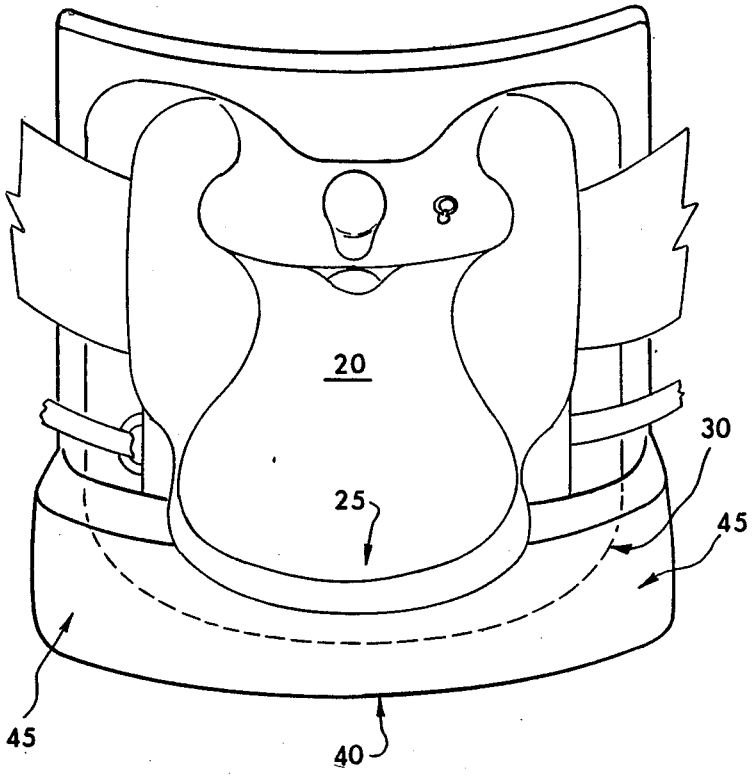
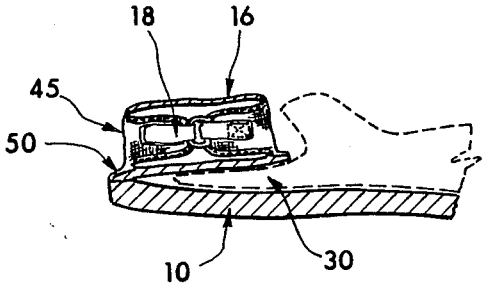
Fig. 8

SADDLE BLANKET WITH COMPARTMENTS

BACKGROUND OF THE INVENTION

1. Field of the Invention: The present invention relates to the field of saddle bags and saddle blankets for ordinary saddles for use with horses and also other animals including mules, donkeys, llamas, etc.

2. Statement of the Problem: Previous to the present invention, saddle bags were normally strapped to the sides of a saddle. The bags would be attached to the saddle only after the saddle was already mounted on the horse or other animal. The bags were placed over the saddle skirt and secured there by straps and buckles. These bags have a tendency to slip and bounce during movement of the horse, thereby distracting the horse.

Another problem with the prior art bags is the bags bouncing against the horse; particularly while the horse is trotting. This not only creates a distraction to the horse but on long rides can bruise the horse. The bags cannot be tightened adequately to prevent the bags from bouncing and the bags will eventually slip due to the movement of the horse and saddle.

The saddle bags of the prior art are difficult to access by a mounted rider. The rider often would have to dismount in order to remove objects from the bags.

Another problem with the bags is protection of the contents of the bags from the elements. Frequently on long rides, dust will seep into the bags especially from the sides of the bags and thus into the bag's contents. Also, water, not only from rain, but from stream crossings, can soak the bags and their contents.

One solution to these problems has been to attach the bags directly onto a saddle blanket. This is usually done by using an oversize blanket and attaching the bags to the portions of the blanket extending beyond the saddle. The oversize blanket tends to be distracting to the horse while the bags normally extend below the blanket and tend to bounce against the horse. This creates even more distraction and discomfort to the horse and rider.

3. Solution to the Problem: The present invention solves the problems associated with the prior art saddle bags. The present invention provides saddle bags incorporated into a saddle blanket. The bags are attached in such a way so as to prevent the bags from slipping or bouncing relative to the blanket therefore relative to the horse.

The bags are attached to the blanket in such a way so the saddle skirt fits between the saddle blanket and the bags. This increases stability between the bags, the saddle, the blanket and the horse.

The blanket of the current invention is of standard length and width to fit a typical western saddle so there is no distraction or discomfort to the horse as with the oversize blankets of the prior art.

The bags are designed to fit the shape of the saddle cantle and skirt. This provides more stability to the saddle and the bags.

The attachment of the bags to the blanket allows the saddle, blanket and bags to be quickly and easily mounted on the horse. Once on the horse, the bags are designed to be easily accessible to the mounted rider.

The bags are provided with protective flaps designed to prevent dust, water and other elements from contaminating the contents of the bags.

These solutions and other features of the present invention will be evident from the following description in conjunction with the drawings.

SUMMARY OF THE INVENTION

The present invention is an improved saddle blanket. The blanket is designed for use with a typical western saddle of ordinary design. The blanket of the present invention is a typical saddle blanket of standard dimensions. The blanket is provided with a group of closed compartments attached to the rear end of the blanket. The compartments include two side compartments and a central compartment between the side compartments.

The compartments are attached only at their outer edges along the periphery of the blanket. This design allows the skirt of the saddle to fit between the blanket and the compartments.

The central compartment is shaped to conform to the cantle of the saddle. This design, of the contoured center compartment and the skirt sliding beneath the bags, provides greater stability to the saddle and the bags. The bags are restrained from moving laterally by the peripheral attachment to the blanket and from bouncing up and down by the cantle of the saddle.

In use, the blanket with the attached compartments can be placed over the saddle and then the saddle, blanket and compartments can be simultaneously placed on the horse. The compartments will be securely attached without any further securement or adjustment being necessary. When the saddle is securely mounted on the horse, then the compartments will also be securely mounted relative to the saddle and the horse. The compartments are restrained from slipping or bouncing even when the horse is trotting.

The compartments are designed to be easily accessible to a mounted rider with no need for the rider to dismount. The compartments are also provided with protective flaps to seal the contents of the compartments from the outside elements. These flaps include inner side flaps which fold over from each side and an outer flap which folds down to form the top side of the compartment. The outer flap is then secured by well known attachment means such as a buckle and strap.

These and other features of the claimed invention will be obvious from the following detailed description in conjunction with the drawings.

DESCRIPTION OF THE DRAWINGS

FIG. 2 is a top view of the saddle blanket of the present invention.

FIG. 3 is a top view of a typical saddle with the blanket of the present invention.

FIG. 7 is an exploded view of section 7—7 of FIG. 5.

FIG. 8 is an exploded view of section 8—8 of FIG. 5.

DESCRIPTION OF THE INVENTION

Figure 1:
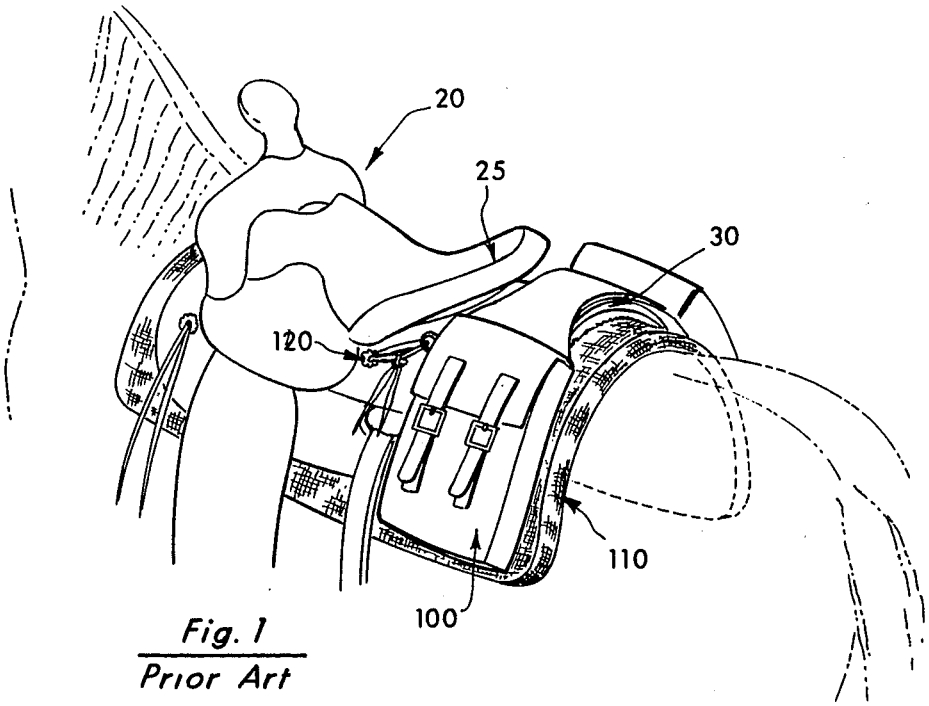
Fig. 1 Prior Art
FIG. 1 is a perspective view of a prior art saddle bag.

A traditional saddle bag 100 is shown in FIG. 1. This saddle bag 100 must be attached to the saddle 20 after the saddle is mounted on the horse or other animal. The bags are thrown over the saddle skirt 30 and secured to the saddle by straps 120. The bags have a tendency to slip and bounce against the horse during movement of the horse.

Figure 4:
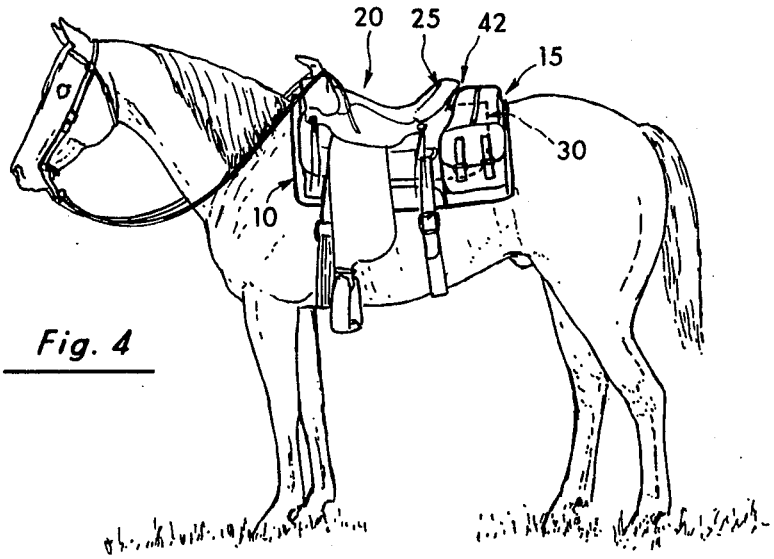
FIG. 4 is a side view showing a saddle and the blanket of the present invention as mounted on a horse.
Figure 5:
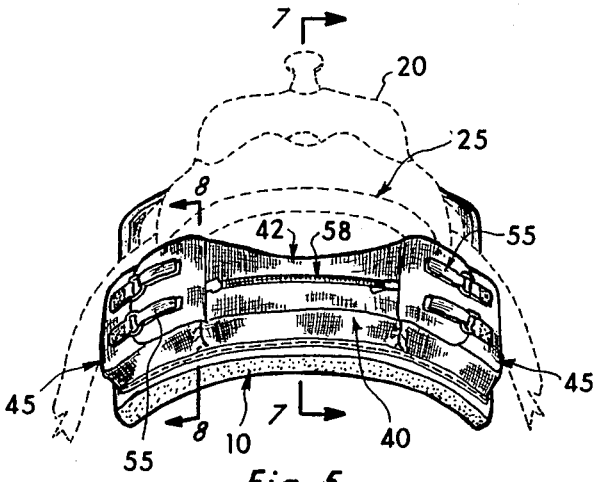
FIG. 5 is an end view of the blanket of the present invention in use with a saddle.
Figure 6:
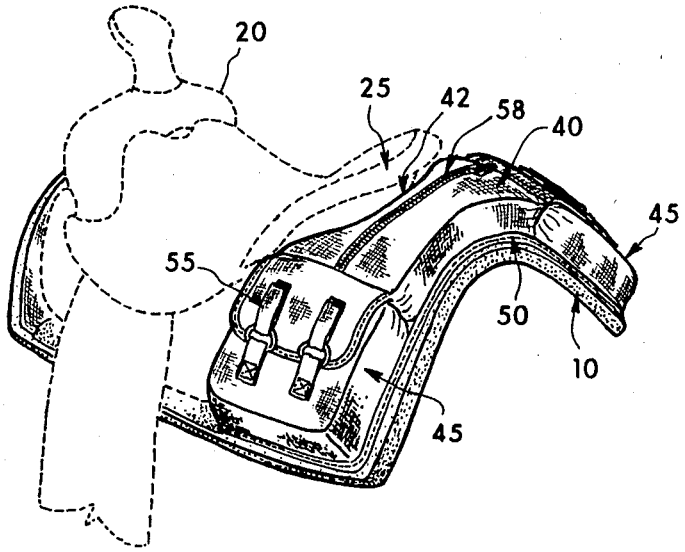
FIG. 6 is a perspective view of a typical saddle mounted on the blanket of the present invention.

The present invention is an improved saddle blanket 10 as shown in FIG. 2. The blanket 10 is designed for use with an ordinary western saddle 20 as shown in FIG. 3 having a cantle 25 and a saddle skirt 30. The blanket 10 is an improvement over a standard saddle blanket. The blanket of the current invention is thirty inches long, the length of most standard saddle blankets, extending substantially the length of the saddle. In the preferred embodiment, a group of closed compartments 15 have been added to the rear end of the blanket 10 as shown in FIG. 2. The compartments 15 include side compartments 45 and a central compartment 40 located between the side compartments 45 to be situated directly behind the saddle when mounted as shown in FIG. 3. The compartments 15 are attached at their outer edges as shown in FIGS. 7 and 8, such as by sewing, only along the periphery of the blanket as indicated by the dotted line 50 as shown in FIG. 6. This method of attachment is designed to allow the saddle skirt 30 to fit underneath the compartments 15 as shown in FIG. 4.

In the preferred embodiment, the compartments 15 extend only to the border of the saddle blanket as shown in FIGS. 2 through 6. The invention is not meant to be limited to this description but extends to other modifications and variations within the scope of the inventive concept. For instance, the number and sizes of the compartments may be enlarged or reduced. The compartments may be formed of canvas, leather or any other suitable material.

In the preferred embodiment, the central compartment 40 is shaped to conform to the cantle 25 of the saddle 2 as shown in FIGS. 2 through 6. The contour 42 of the center compartment 40 allows the center compartment to fit closely beneath the cantle 25 and over the top of the skirt 30 of the saddle. The attachment of the compartments 15 to the blanket along the periphery of the blanket prevents the bags from moving laterally. The compartments 15 are restrained from bouncing up and down by the peripheral attachment to the blanket 10 and by the close fit of the compartments 15 against the cantle 25 of the saddle 20. The compartments 15 are restrained from slipping or bouncing even while the horse is trotting.

In use, the improved blanket 10 of the present invention is thrown over the saddle 20. The saddle skirt 30 is slipped between the blanket 10 and the compartments 15. Typically, the saddle is stood up on its front end and the blanket 10 is slipped under the rear end of the saddle 20 until the bags 15 are fitted firmly against the saddle cantle 25. The saddle 20 and blanket 10 are simultaneously placed on the back of the horse and then secured by well known means. Once the saddle is securely mounted on the horse, then the compartments are also securely mounted relative to the saddle and the horse. The compartments 15 can be loaded either before or after mounting on the horse. This is much easier and quicker compared to the prior art method of placing the saddle and blanket on the horse, then attaching and securing the saddle bags. With the current invention, the saddle, blanket and bags are easily mounted in one step. Once the blanket is mounted on the horse, the compartments 15 are designed to be easily accessed. The rider can remove the contents of the bags without having to dismount.

The compartments 15 are designed to protect the contents of the compartments from outside elements, such as dust, rain etc. The side compartments 45 are provided with an inner set of flaps 16 and an outer flap 17 as shown in FIGS. 2 and 8. The inner flaps 16 fold over from each side of the compartments 45. The inner flaps are then pulled together and secured to one another by fastening means 18, such as a velcro strap and buckle mounted on the inner flaps. The outer flap 17 folds down from the top of the side compartments 45 covering the inner flaps 16 thus sealing the compartment from exposure to outside elements. Securing means 55, such as a buckle and strap or velcro fasteners are provided on the outer flap 17 and the compartment to secure the flaps to the compartment thus sealing the compartments from outside elements and preventing the contents from falling out.

The center compartment 40 in the preferred embodiment is provided with a zipper 58 having inner and outer protective flaps which will protect the contents from exposure to the outside elements. The fasteners 55 and 58 can easily be manipulated from any angle. Thus, the compartments are easily accessible to the rider while still mounted on the horse.

As described above, with the blanket and bags of the current invention, a rider can easily mount the blanket and bags onto a horse. Once mounted, the bags will be restrained from bouncing or slipping even while the horse is trotting. The contents of the bags are protected from outside elements and are easily accessible to the mounted rider.

The method of manufacturing the improved saddle blanket of the present invention includes the steps of:

(a) selecting a saddle blanket 10 of dimensions fitting the saddle 20 the blanket 10 is to be used with;

(b) forming side compartments 45 with side flaps 16, an outer top flap 17 and flap securing means 18;

(c) forming a center compartment 40 with a contour 42 adapted to conform to a cantle 25 of the saddle 20;

(d) attaching the side compartments 45 to each side of the blanket 10 and attaching the center compartment 40 between the side compartments 45 to the blanket 10 so that the contour 42 will fit snugly against the saddle cantle 25;

(e) attaching the compartments 15 only at the outer edges of the compartments 15 to the periphery of the blanket 10 so that the skirt 30 of the saddle 20 will fit over the blanket 10 and beneath the compartments 15.

The claimed invention is not meant to be limited to the description of the preferred embodiment but encompasses other modifications and alterations within the range and scope of the inventive concept.

I claim:

1. A saddle blanket for use with a horse saddle having a cantle and a skirt, said blanket comprising a side compartment attached on each side of said blanket and a center compartment attached to said blanket directly behind the cantle of said saddle when mounted, said center compartment being contoured to conform to said cantle of said saddle and means to attach said compartments only at the outermost edges of said compartments along the periphery of the rear end portion of said blanket.

2. A saddle blanket as set forth in claim 1 having the dimensions of a standard size blanket.

3. A saddle blanket as set forth in claim 1 wherein said side compartments include inner side flaps, an outer flap and flap securing means to seal said compartment from outside elements.

4. A saddle blanket for use with a horse saddle having a cantle and a skirt comprising at least one compartment having only its outermost edges attached along the periphery of the rear end portion of said saddle blanket to allow said skirt of said saddle to fit between said at least one compartment and said blanket.

5. A saddle blanket as set forth in claim 4 wherein said compartment includes a side compartment on each side of said blanket.

6. A saddle blanket as set forth in claim 5 wherein each of said side compartments includes inner side flaps, an outer flap and flap securing means to seal said compartment from outside elements.

7. A saddle blanket as set forth in claims 4 or 5 wherein said compartment further comprises a center compartment attached to said blanket to be directly behind the cantle of said saddle when mounted, said center compartment being contoured to conform to the cantle of said saddle.

8. A saddle blanket as set forth in claim 4 having the dimensions of a standard saddle blanket.

9. A saddle blanket of standard dimensions for use with a horse saddle having a skirt and a cantle, said blanket comprising a plurality of compartments and means to attach the outermost edges of said compartments only along the periphery of the rear end portion of said blanket to allow said skirt of said saddle to fit beneath said compartments but over said blanket, said compartments comprising a center compartment contoured to fit snugly against the cantle of said saddle, said compartments further comprising a side compartment attached on each side of said blanket, said side compartments comprising inner side flaps, an outer flap and flap securing means to seal the compartment openings from outside sources.

10. A saddle blanket of standard dimensions for use with a saddle having a skirt and a cantle, said blanket comprising a first side compartment, a second side compartment and a center compartment;

said first side compartment having a top opening comprising first inner side flaps folding over from each side of said opening of said first side compartment, means to secure said first inner flaps together, a first outer flap which folds down from the top of said first side compartment opening over said first inner flaps and fastening means to secure said first outer flap to said first compartment;

said second side compartment comprising a top opening, second inner side flaps folding over from each side of said opening of said second side compartment, means to secure said second inner flaps together, a second outer flap which folds down from the top of said second side compartment over said second side compartment inner flaps and fastening means to secure said second outer flaps to said second side compartment;

said center compartment comprising a contoured portion adapted to fit snugly against said cantle of said saddle and zipper means to allow access to said center compartment;

said first side compartment is attached to one top side of the rear end portion of said blanket, said second side compartment is attached to the other top side of said rear end portion of said blanket and said center compartment is attached between said side compartments on said top side of said rear end portion of said blanket;

said first side compartment, said second side compartment and said center compartment attached only at the outermost edges of each of said compartments to the periphery of said rear end portion of said blanket so that the skirt of said saddle can fit beneath said compartments but over said blanket.

11. A method for making a saddle blanket having enclosed compartments, said method comprising the steps:

(a) selecting a saddle blanket of dimensions fitting the saddle said blanket is to be used with;

(b) forming side compartments with side flaps, an outer top flap and flap securing means;

(c) forming a center compartment with a contour adapted to conform to a cantle of a saddle;

(d) attaching said side compartments to each side of said blanket and attaching said center compartment between said side compartments to said blanket so that said contour will fit snugly against said saddle cantle;

(e) attaching said compartments only at the outer edges of said compartments to the periphery of said blanket so that a skirt of a saddle will fit over said blanket and beneath said compartments.

12. A method for making a saddle blanket having at least one compartment, said method comprising the steps:

(a) selecting a saddle blanket of dimensions fitting the saddle said blanket is to be used with;

(b) forming a center compartment with a contour adapted to conform to a cantle of a saddle; and (c) attaching said center compartment only at the outermost edge of said center compartment to the periphery of the rear end portion of said blanket so that a skirt of a saddle will fit over said blanket and beneath said compartment and the contour of said compartment will fit snugly against a cantle of said saddle.

13. A method of mounting a saddle blanket having at least one compartment attached only to the periphery of said blanket to a saddle having a skirt and a cantle, and simultaneously mounting said blanket, said at least one compartment and said saddle onto an animal, said method comprising the steps:

(a) standing said saddle up on the front portion of said saddle;

(b) slipping said blanket under the rear end portion of said saddle so that the skirt of said saddle is between said at least one compartment and said blanket;

(c) simultaneously mounting said blanket, said at least one compartment and said saddle together as one unit onto said animal; and (d) securing said saddle to said animal by fastening means thus securing said blanket and said at least one compartment to said animal.

* * * * *